United States Patent [19]

Dysarz

[11] Patent Number: 4,676,311

[45] Date of Patent: Jun. 30, 1987

[54] MULTIWELL PUMPING DEVICE

[76] Inventor: Edward D. Dysarz, 11423 Triola La., Houston, Tex. 77072

[21] Appl. No.: 668,515

[22] Filed: Nov. 5, 1984

[51] Int. Cl.[4] ..... E21B 43/00

[52] U.S. Cl. ..... 166/68.5; 417/343

[58] Field of Search ..... 166/68, 68.5, 75 R, 166/104, 105, 345; 74/89.2, 89.21, 89.22, 590, 591, 592; 417/15, 415, 539, 329, 338, 343, 341, 339, 362; 187/94; 254/266

[56] References Cited

U.S. PATENT DOCUMENTS

| | | | |
|---|---|---|---|
| 739,298 | 9/1903 | Dobson | 74/592 |
| 1,487,832 | 3/1924 | Barney | 74/592 |
| 4,062,640 | 12/1977 | Gault | 74/89.22 |
| 4,063,825 | 12/1977 | Chardonneau et al. | 417/343 |
| 4,076,218 | 2/1978 | Gault | 74/89.22 |
| 4,147,477 | 4/1979 | Chardonneau et al. | 417/539 |
| 4,179,947 | 12/1979 | James | 187/94 |
| 4,197,766 | 4/1980 | James | 74/89.2 |
| 4,404,863 | 9/1983 | James | 166/68 |
| 4,479,656 | 10/1984 | Collins | 166/345 |
| 4,534,706 | 8/1985 | Palm et al. | 74/89.2 |

*Primary Examiner*—Stephen J. Novosad
*Assistant Examiner*—Bruce M. Kisliuk
*Attorney, Agent, or Firm*—David M. Ostfeld

[57] ABSTRACT

A pumping device and an efficient method of pumping petroleum from two or more low pressure wells of close proximity. The device consists of a motor that rotates a drive sprocket in a clockwise direction and a counter clockwise direction. The sprocket has a roller chain movably connected to it. The roller chain is connected to a sucker rod in a well at one end, then runs through a series of idler sprockets and said drive sprocket, then runs through another series of idler sprockets and into another well where the other end of the said roller chain is connected to another sucker rod. The device is flexibly mounted on the casing or conductors of two or more wells. The chain that goes into each well is protected by a pump casing that is bolted to the top of each well casing or well conductor. Each pump casing runs inside of each well casing or well conductor. At the bottom of each pump casing is a spring that absorbs the energy of the sucker rods as the direction of the chain and sucker rod is reversed from a downward direction to an upward direction.

5 Claims, 26 Drawing Figures

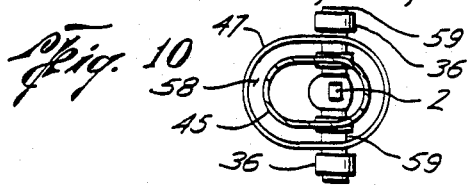
Fig. 10
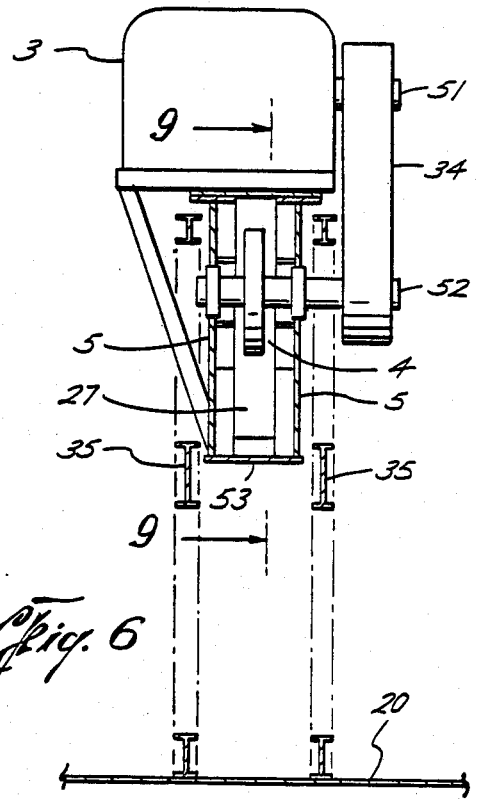
Fig. 6
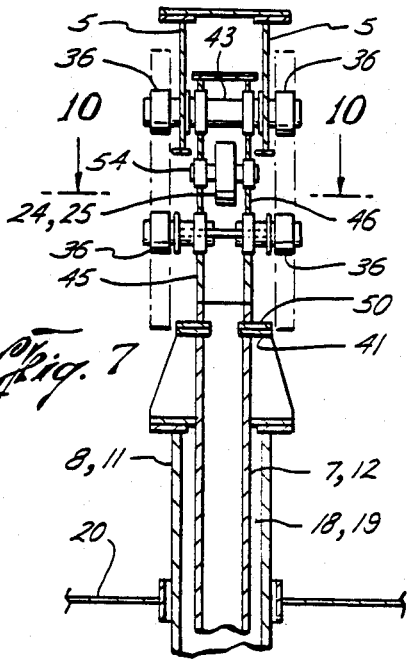
Fig. 7
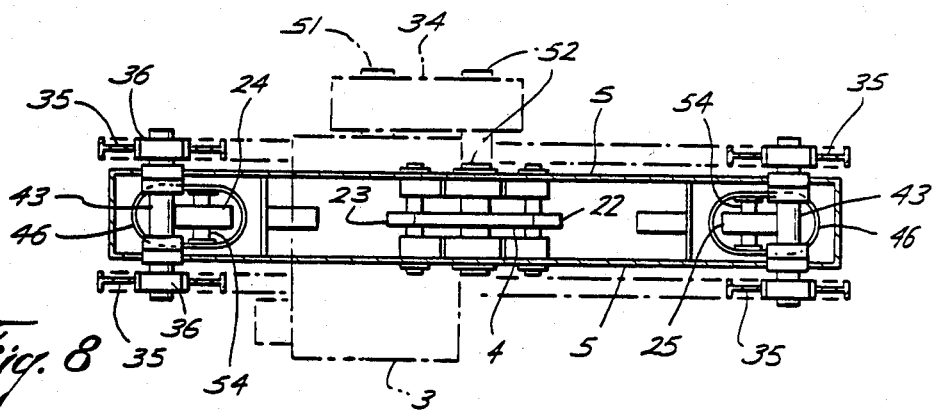
Fig. 8
Fig. 9
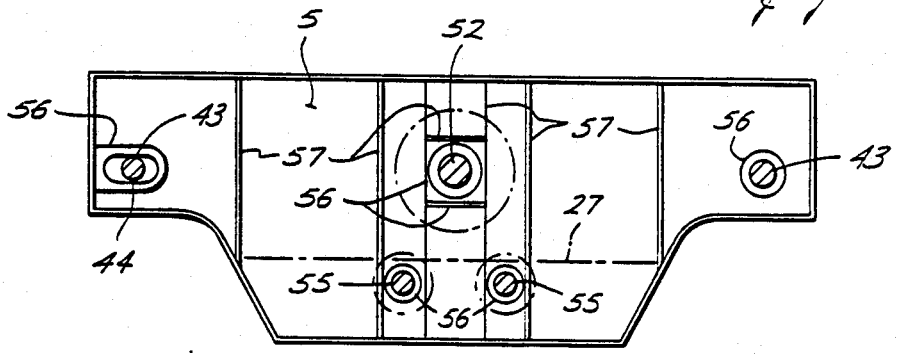

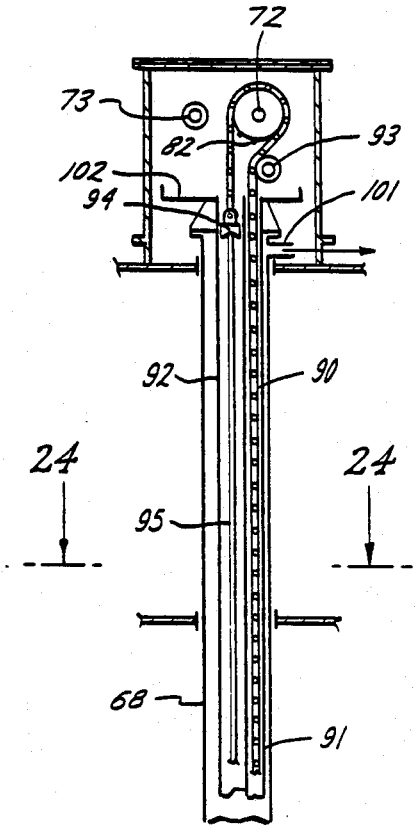
Fig. 20
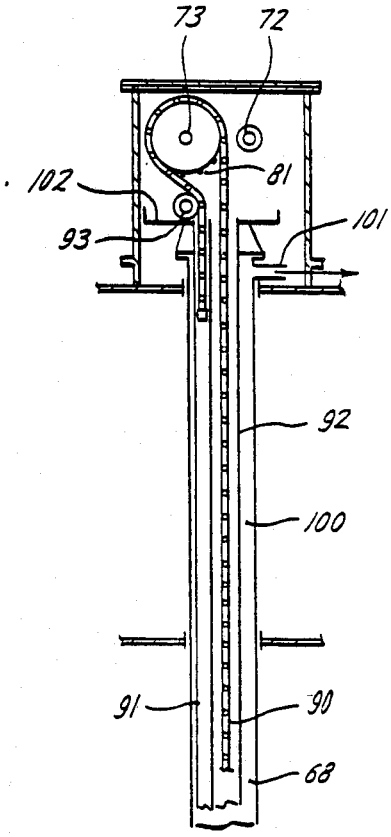
Fig. 21
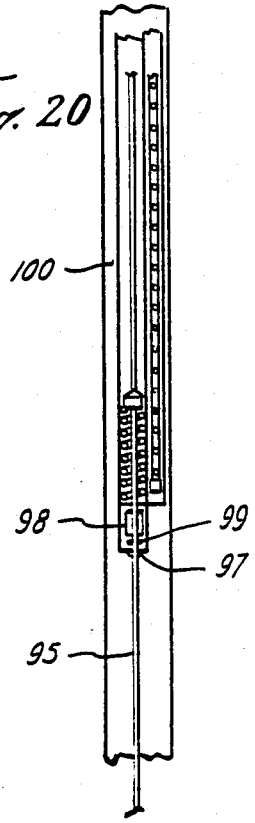
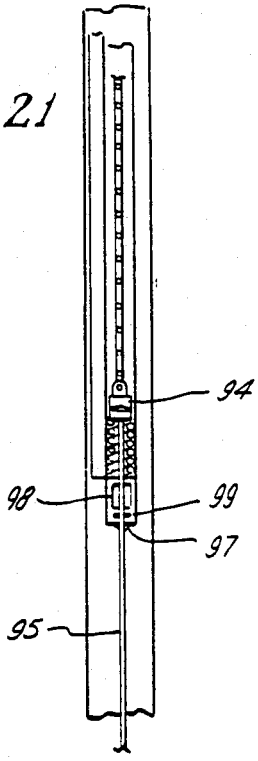

MULTIWELL PUMPING DEVICE

BACKGROUND OF THE INVENTION

1. Field of the Invention

The present invention relates to the artificial lifting of petroleum from low pressure wells by lifting the petroleum, the sucker rods and chain from one well while utilizing the sucker rods and chain of another well as a counter weight. The present invention has been found to be particularly useful in the offshore petroleum pumping and production art and hence will be discussed with particular reference thereto. However, the present invention is applicable to other types of petroleum pumping and production on land and also subsea. The present invention may also be used to pump saltbrine, sulphur or other minerals contained or suspended in a liquid form.

2. Description of Prior Art

The sucker rod pumping system is the most widely used artificial petroleum lifting system on land today. About 90% of the wells that are in production on land that require the petroleum to be artificially lifted (as opposed to wells with sufficient gas pressure to push the petroleum out of the ground) from say fifteen thousand feet (15,000') or less use sucker rods. Today petroleum organizations are attempting to use sucker rods to go as deep as 18,000 to 20,000 feet.

The device that causes a sucker rod to move up (gravity causes the sucker rod to move down) is called a pump jack in the petroleum industry. A pump jack is a device that is often seen on oil fields with a horse head looking device moving up and down. The horse head is pulling up on the sucker rod and allowing it to fall. As it pulls up on the sucker rod it also pulls up petroleum with the rod and valves connected to the rod. As the horse head moves down the sucker rod drops.

The typical pump jack has several major drawbacks that make it difficult to use on offshore production platforms.

(1) A pump jack takes up a lot of space. In some cases a typical pump jack will take up a deck area of 29 feet by 9 feet. The well heads on a production platform are usually about 7 feet to 8 feet apart, thus not far enough apart to place the pump jacks side by side.

(2) The weight of a pump jack is too great to be supported by most offshore production platforms. When the wells lose their pressure they are often old wells with an old production platform supporting the wells. The production platform in most cases will not have sufficient weight bearing capacity to support a twenty ton pump jack along with the sucker rod pull of about another twenty tons. If the platform has say ten (10) wells, it must be capable of supporting an additional 400 tons of deck load which most likely it cannot.

(3) In wells of twelve thousand feet (12,000) or greater a pump jack will only produce about 50 barrels of fluid a day which most likely is not sufficient production to invest in a new offshore production platform or to rebuild an old production platform.

(4) Most pump jacks require a large rotating counter weight or offset flywheel to help lift the long sucker rods. The counter weight will often set up with the natural frequency of the production platform and destroy the platform.

(5) Each time the sucker rod is dropped by gravity and then instantaneously pulled back up, there is a great stress reversal on the sucker rod. This stress reversal takes place about once every six seconds with a pump jack. The great number of stress reversals will cause the sucker rods to fatigue after a certain time period. The results are that the sucker rod will fail or it must be replaced before it fails.

(6) The fatigue factor of a sucker rod will require that the rod is a greater diameter which will increase the weight of the rod and therefore increase the size of the pump jack and the size of the counter weight of the pump jack. This is one of the major limiting factors that prohibits the use of an 18,000 to 20,000 foot or greater sucker rod. The extra weight of the sucker rod will also increase the cost of the sucker rod and the pump jack.

There are also pumps that are placed at the bottom of the well say at 20,000 feet. These are called submersible pumps. Submersible pumps push the petroleum up the well to the surface. The problem with submersible pumps is that they must work in a very hot and caustic environment; they must push petroleum up against 10,000 to 20,000 feet of hydrostatic pressure and they must work with sand, silt and other debris.

A submersible pump will clog up with the sand, silt or other debris and must be pulled out of the well and be replaced as often as once every two months. Replacing a submersible pump is very costly as expensive labor and equipment must be employed in the pulling and reinstalling of another pump. The well is also shut down for about a week which results in another loss of revenue.

A submersible pump is only used where a sucker rod pump cannot be used or where the production will not be sufficient with a sucker rod pump.

Another type of petroleum pump that is widely used in the petroleum industry is known as the long stroke pump.

There are two types of long stroke pumps although in practice they are both very similar. One type requires a tower that has a sheave at the top. Running over the sheave is a rope or wire rope that has a large counter weight at one end and the other end of the rope is connected to the sucker rod. As the sucker rod is pulled up and out of the well the counter weight at the other end of the rope assists the motor in pulling up on the sucker rod. The other method requires a counter weight well. It still requires a sheave, a wire rope and a counter weight but it also requires a counter weight well. The counter weight well must be bored about 50 feet into the earth. Both systems require a large counter weight.

The problems with both systems are first that they weight a lot due to the large counter weight. They also take up a lot of space due to the counter weight, the counter weight well and or the size of the tower.

Some offshore platforms use the tower type of pump but there are several major limitations. One limitation is the tower itself. The tower adds a wind load to the production platform that is very sensitive to extra wind loading and therefore not more than one or two towers may be added to the platforms; most offshore production platforms have three or more wells. Another limitation is the base size of the tower. They are very large at the base and therefore take up a lot of space. Another limitation is the length of the stroke. The stroke is limited to the height of the tower or the depth of the counter weight well which is about 50 feet. When the height or depth of either unit is over 50 feet the cost of the unit increases at a greater rate.

Two examples of tower type long stroke pumps are EWING, U.S. Pat. Nos. 3,695,117, Oct. 3, 1972, BENDER, 3,248,958 May 3, 1966. Another long stroke pumping unit with a counter weight well is GAULT, 4,062,640 Dec. 13, 1977.

Several other pumping devices have been known and used before and typical examples thereof are shown in U.S. Pat. Nos. 3,640,342 issued on Feb. 8, 1972 to GAULT: 224,862 filed Dec. 18, 1879 to BIGRLOW: 1,970,596 issued Aug. 21, 1934 to COBERLY: 1,928,532 issued Sept. 26, 1933, to GILLESPIE: 3,977,259 issued Aug. 31, 1976 to GOLDFEIN: 4,306,463 issued on Dec. 22, 1981 to KING; 3,018,865 filed June 22, 1956 issued to BLACKBURN: 2,997,887 issued on Aug. 29, 1961 to LOTT: 3,646,833 issued on Mar. 7, 1972 to WATSON. None of the devices however, teach the art of pumping petroleum from two or more wells utilizing one sucker rod inside of one well to act as a counter weight for the second sucker rod inside of a second well thereby increasing pumping efficiency.

SUMMARY OF THE INVENTION

The present invention is a highly efficient device and method to economically extend the production life, increase production and to reduce the cost of production of petroleum wells.

A motor rotates a sprocket that drives a chain. The chain is connected to a sucker rod in a well at one end and another sucker rod in a well at the other end. The chain moves up and down inside of a casing inserted into each well. At the bottom of each casing is a spring which will arrest the velocity of the sucker rod and gently reverse the direction of the sucker rod.

The motor rotates the sprocket which in turn causes the chain to move in an upward direction pulling the sucker rod and petroleum up with it; at the same time, the other end of the chain that is connected to another sucker rod in another well is assisting the first end of the chain and sucker rod by acting as a counter weight to improve the efficiency of the pump.

The gradual stress reversal caused by the spring at the bottom of the pump casing along with the longer stroke with less stress reversals will decrease the fatigue on the sucker rod. The decrease of metal fatigue on the sucker rod will increase the life of the sucker rod. The longer stroke will also increase the well production. The use of sucker rods as a counter weight for other sucker rods will require less power from the drive motor and therefore reduce the cost of pumping from the well or it will also increase the capacity of the unit to pull longer sucker rods. The greater efficiency of one sucker rod acting as a counter weight for another sucker rod will reduce the size and weight of the machinery by about 80% and therefore will allow the device to be used on offshore production platforms as well as land wells.

In the preferred embodiment the unit may be equipped with idler sprockets, an oil bath, cam followers, a gear box, bearings, guide frames and a control system.

BRIEF DESCRIPTION OF THE DRAWINGS

For further understanding of the nature and objects of the present invention reference should be had to the following detailed description of the preferred embodiment thereof, taken in conjunction with the accompanying drawings, in which parts are given like numerals and wherein:

FIG. 6 is a cross sectional view of FIG. 5.

FIG. 7 is another cross sectional view of another part of FIG. 5.

FIG. 8 is a cross sectional plan view of FIG. 5.

FIG. 9 is a cross sectional view of FIG. 8.

FIG. 10 is a cross sectional view of another part of FIG. 5.

FIG. 20 is a sectional elevation taken at a right angle of FIG. 19.

FIG. 21 is a sectional elevation taken at a right angle of FIG. 19.

DETAILED DESCRIPTION OF THE PREFERRED EMBODIMENTS

The preferred embodiment of the device and the method of the present invention may be used to pump petroleum from offshore production platforms any may have a single stroke of from five (5) feet to well over one thousand (1000') feet. The pumping device may also pump from five (5) barrels of petroleum a day to over five thousand (5000) barrels of petroleum a day.

The superior pumping capacity of this pumping device is accomplished by utilizing one well as a counter weight for another well and vis-a-vis on the return cycle.

A particularly important application of the present invention is the pumping of petroleum on an offshore production platform or other marine structures. It also has application for use on subsea well heads, floating production facilities and land production facilities.

The preferred embodiment and the other embodiments place more emphasis on pumping petroleum from offshore production platforms but it is equally capable of pumping petroleum from subsea installations, floating production facilities and land based production facilities.

DEVICE AND ITS METHOD OF USE

Figure 1:
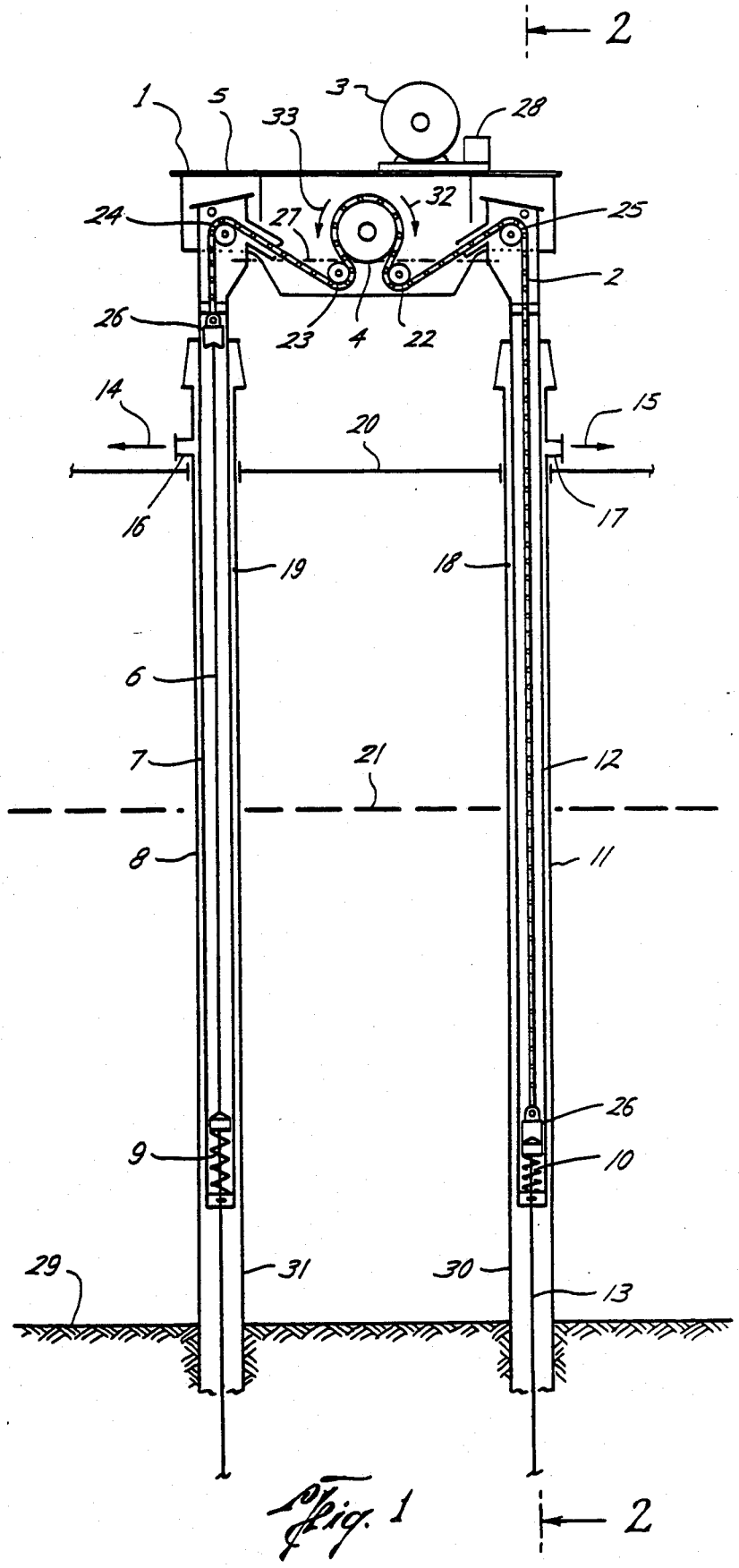
FIG. 1 is a sectional elevation view of embodiment 1 of the apparatus of the present invention showing two wells connected by a common pumping unit.

Referring to FIG. 1 the preferred embodiment is shown. Pump device 1 has a roller chain 2 that runs from the right well 30 over the right upper idler sprocket 25, under the right lower idler sprocket 22 through the oil bath 27 over the drive sprocket 4 back into the oil bath 27, under the left lower idler sprocket 23, over the left upper idler sprocket 24 and into the left well 31. Right well 30 and left well 31 are supported on the sea floor 29. The wells 30 and 31 are supported on the sea floor 29 by the right conductor 11 and the left conductor 8 that are cemented into place not shown far below the sea floor 29.

When the drive sprocket 4 rotates in a clockwise direction 32 it causes the chain 2 to move up in the left well 31 which in turn pulls up on the left sucker rod 6 which pulls petroleum up through the left gap 19 that exists between the left pump casing 7 and the left conductor 8. As the petroleum is pulled up into the left gap it passes out through the left outlet 16 in direction of the flow from left well 14. The left sucker rod 6 is connected to the chain 2 by the chain to sucker rod connector 26.

As the left sucker rod 6 is pulled up by the sprocket 4 turning in a clockwise direction 32 the right sucker rod 13 is acting as a counter weight by pulling down into right well 30. This counter weight action reduces the forces required to lift the left sucker rod 6.

When the chain to sucker rod connector 26 reaches the bottom of the right pump casing 12 it causes the right spring 10 to compress thus gently slowing down the right sucker rod 13 and without putting any stress on the chain 2. When the cycle is being reversed the motor control unit 28 shuts off the drive motor 3 and allows the system to free wheel for several feet. When the right spring 10 rebounds the control unit 28 will reverse the direction of the drive motor 3 which in turn will turn the drive sprocket 4 in a counter clockwise direction 33.

As the right sucker rod 13 is pulled up it pushes petroleum through the right gap 18 between the right pump casing 12 and the right conductor 11, through the right outlet 17 and in the direction of flow from the right well 15. As the second cycle nears its end the chain to sucker rod connector 26 will compress the left spring 9.

The right conductor 8 and left conductor 11 are supported vertically on the sea floor 29 and run through the sea surface 21 and through the deck 20. The conductors 8 and 11 are supported in a horizontal direction by the deck 20 and move up and down due to the expansion from heat and cold.

The wells are flexibly connected by bridge plates 5 which will be shown in greater detail later.

Figure 2:
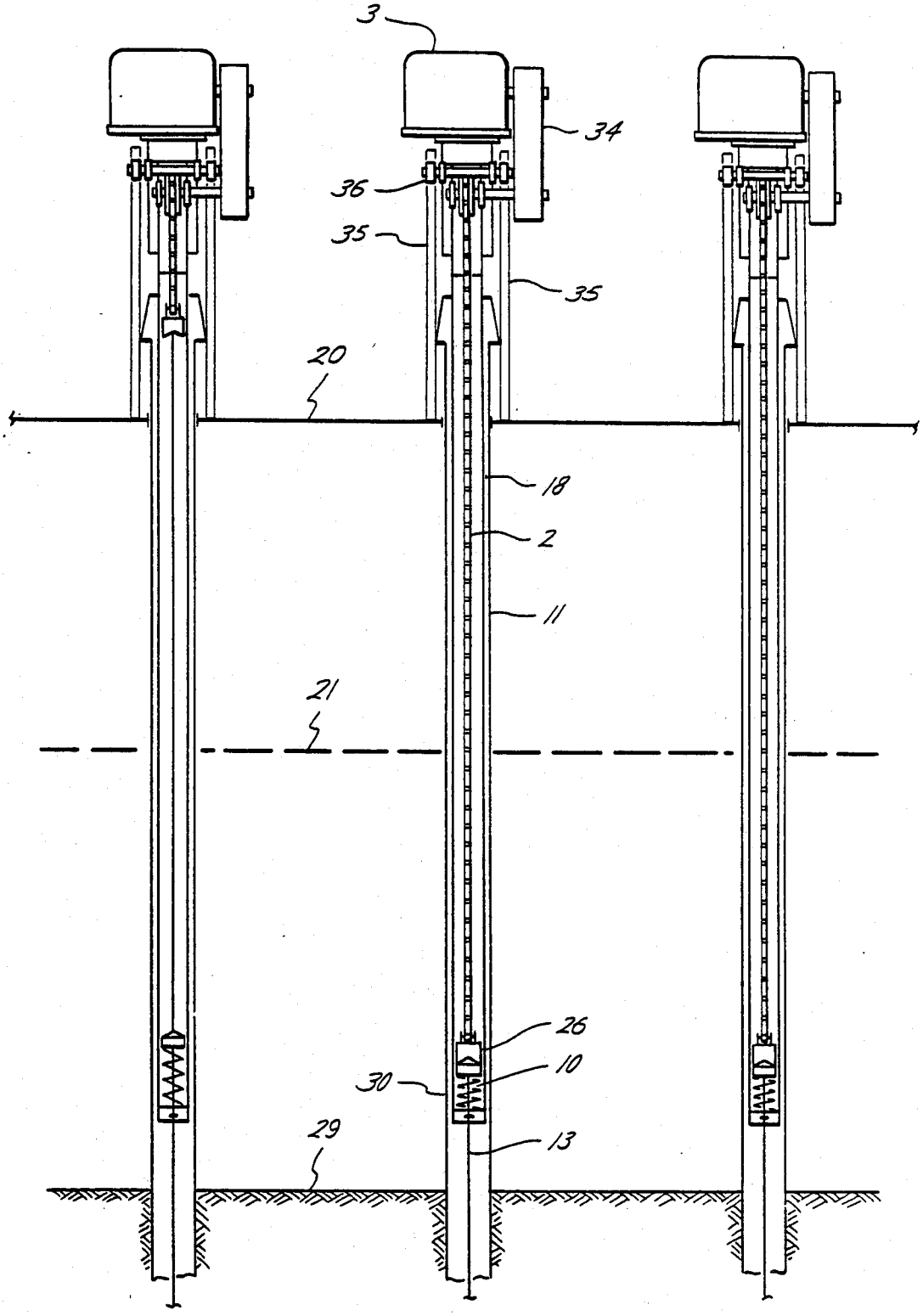
FIG. 2 is a sectional elevation view of the present invention of the preferred embodiment showing the device at a right angle to FIG. 1.

Referring to FIG. 2 there is shown another sectional elevation taken from FIG. 1.

There are three devices shown over six wells 30. Three wells 31 are also behind the three wells 30 shown. The wells 30 come up through the sea floor 29, through the sea surface and through the platform deck 20.

As the wells 30 expand and contract due to the heat of the petroleum and the cold water, the conductors 11 must be free to move up and down. It is common in the art of petroleum production to support the conductors horizontally only so that they may expand and contract freely. The pump device 1 must not hinder the vertical motion of the conductors but it must also be supported by the conductors since most of the offshore production platforms that support low pressure wells are old and may not be capable of supporting much weight.

In order to keep the conductors 8 and 11 in a vertical position and also prevent the chain 2 from pulling the two conductors 8 and 11 together a guide frame 35 is suitably fastened to the deck 20 and holds the conductors 8 and 11 in place by the cam followers 36. This system will be shown in greater detail later.

The drive motor 3 turns the gears not shown in the gear box 34 which turns the drive sprocket 4 that moves the chain 2, chain to sprocket rod connector 26 and sucker rods 6 and 13. The gear box may be replaced with a chain drive.

Figure 3:
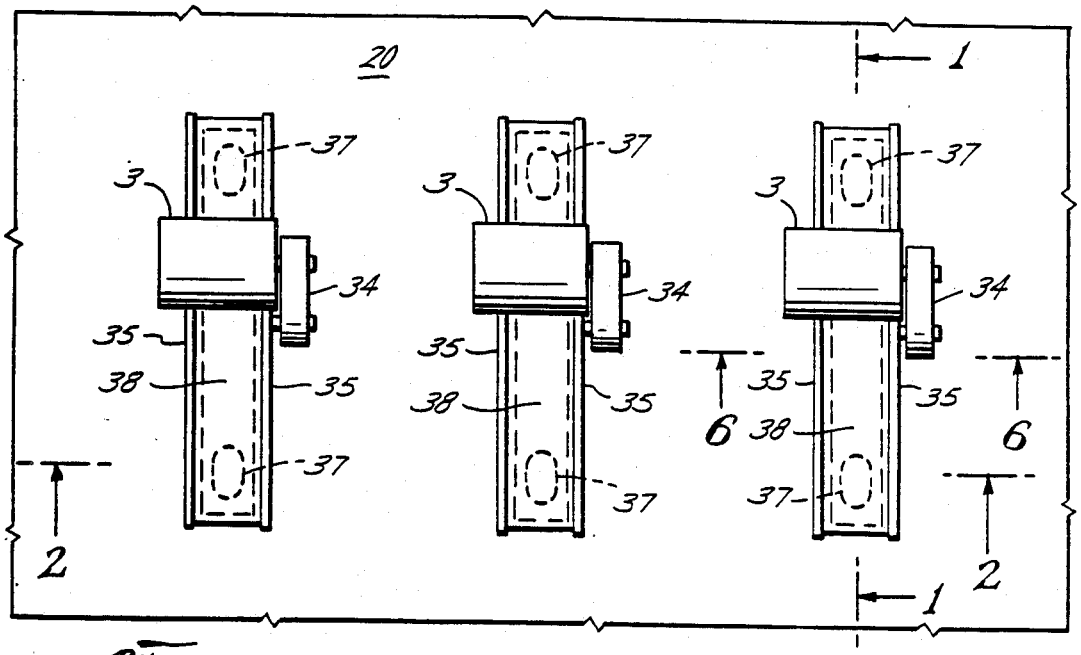
FIG. 3 is a plan view of the preferred embodiment showing three pumps over six wells.

Referring to FIG. 3 there is shown a plan view of three pumping devices 1 over six wells 37. The drive motors 3 are shown connected to the gear box 34. The guide frames 35 are shown on each side of the pump device 1. The sprockets 4, 22, 23, 24 and 25 are not shown in this view because they are sheltered by removable cover plate 38.

Figure 4:
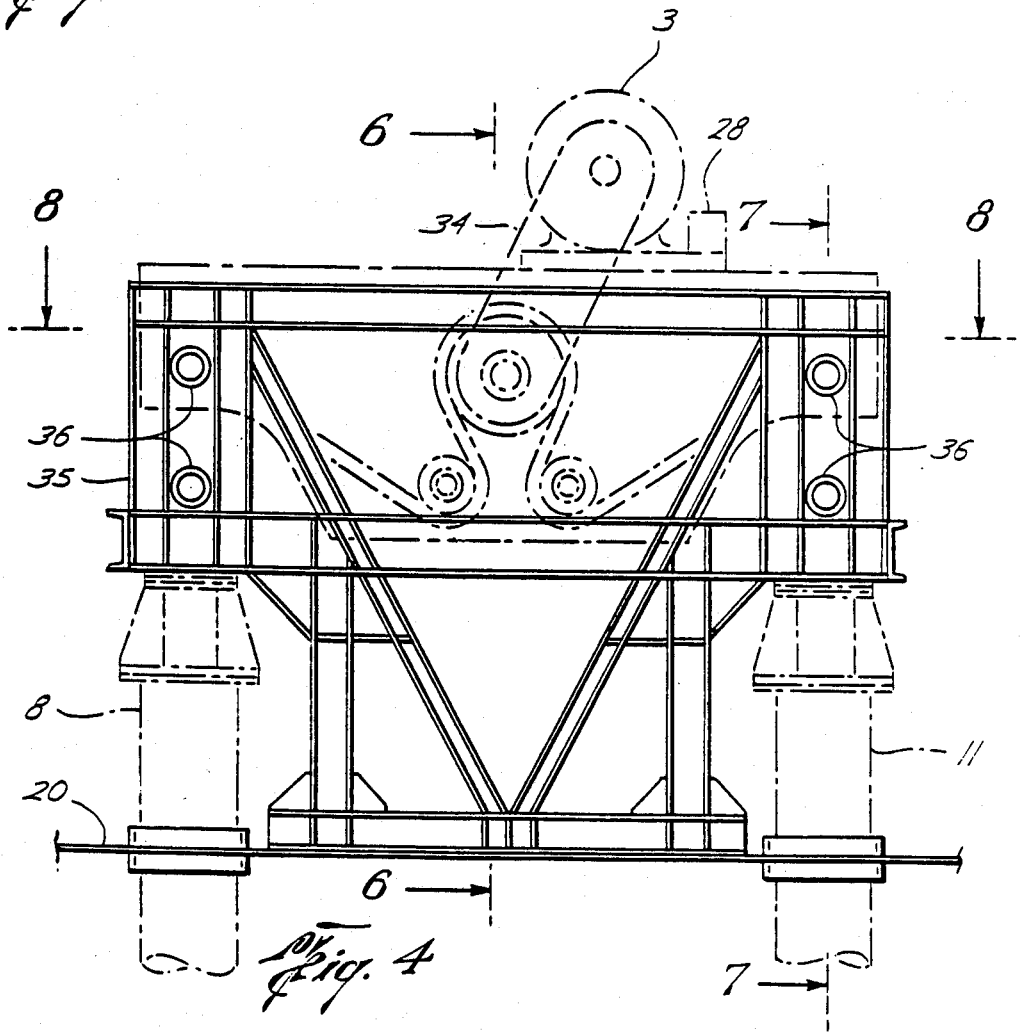
FIG. 4 is an elevation view of the guide frame of the preferred embodiment.

Referring to FIG. 4 there is shown a detailed view of the guide frame 35 and the cam follower 36.

The cam followers 36 roll in the guide frame 35 as the conductors 11 and 8 move up and down. The lower cam follower 36 may not be required.

Also shown is the drive motor 3, gear box 34 and control box 28 and deck as reference points.

Figure 5:
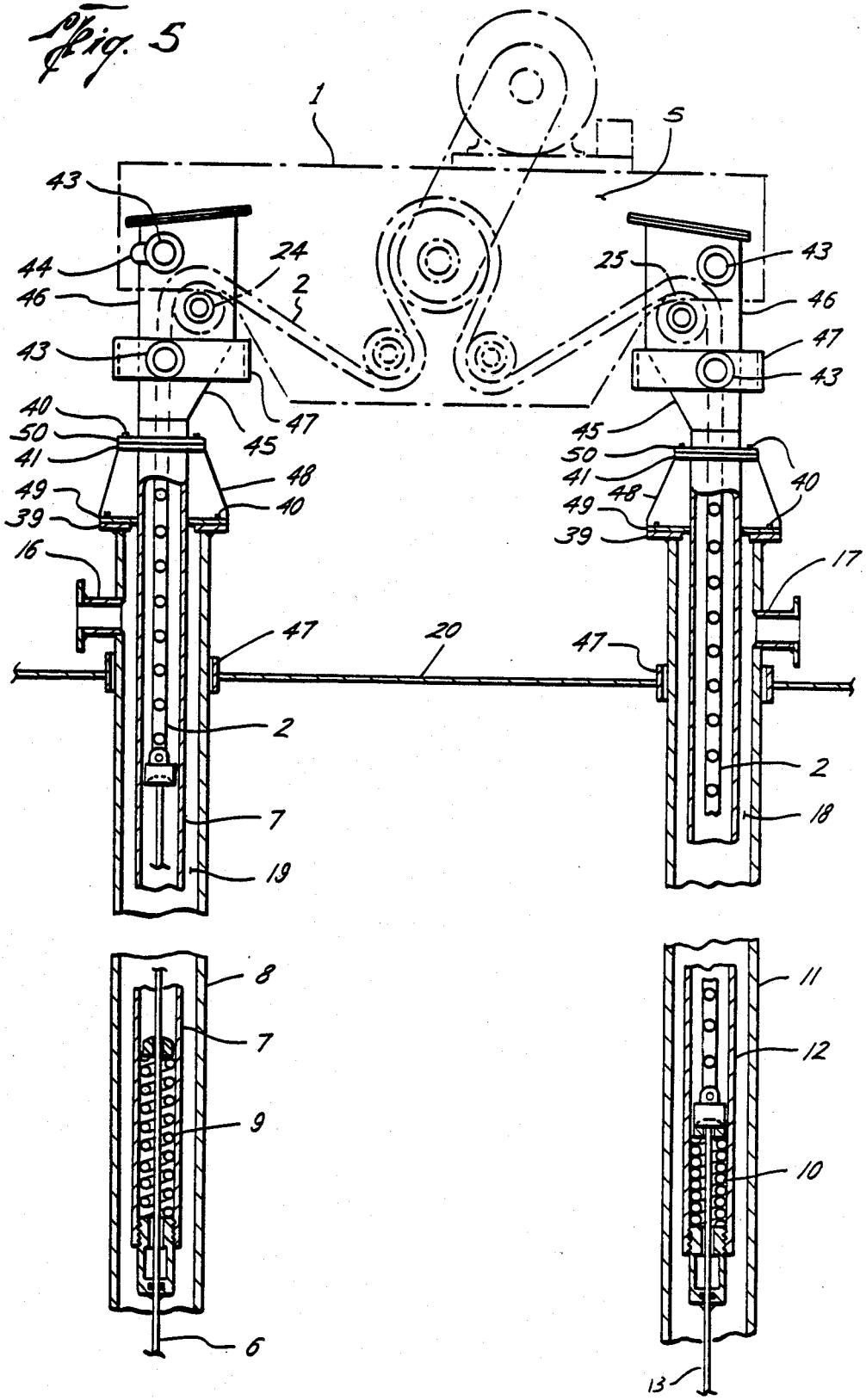
FIG. 5 is another sectional elevation of the preferred embodiment showing enlarged details of the apparatus.

Referring to FIG. 5 there is shown an enlarged view of the connection between the pump device 1 and the conductors 8 and 11.

The conductors have a flange called the lower flange 39 suitably attached to it by welding or other means. Setting on top of the lower flange is the pump casing flange 49 that is suitably attached to the well casing 7 and 12 by welding or other means. The pump casing 7 and 12 is also further supported by support plates 48 that are welded or attached by other suitable means to the pump casing 7 and 12. The top of the well casing 7 and 12 has an upper flange 41 for more support. The entire pump casing 7 and 12 and the device 1 are supported on the lower flange 39 and the conductor pipes 8 and 11.

The top flange 50 is suitably fastened by bolts and nuts 40 to the upper flange 41. The top flange is added so that the pump device 1 may be removed from the pump casing 7 and 12 for repair or replacement purposes or for later removal of the pump casing 7 and 12 for well workover purposes.

A short distance above the top flange 50 is a transition piece 45 to expand the top of the pump casing 7 and 12 in order to accomodate and support the idler sprocket 24 and 25. On the top of the transition piece 45 is the pump support 46. The pump support 46 is oval shaped in section and as noted it supports the idler sprocket 24 but it also supports the trunnion shaft 43 that will pivotably support the pump device 1. The trunnion shaft 43 is sufficiently stout to support all forces exerted on it from the chain 2 and other elements. The trunnion shaft 43 is sufficiently rigid to pivotably support the pump device 1 on one side of the bridge plates 5 but will also pivotably and slideably support the bridge plate 5 on the other side. The bridge plate 5 will have a slot 44 on the other side. The purpose of the slot 44 is to allow one conductor 8 or 11 to expand upward without causing stress on bridge plates 5.

When the conductors 8 and 11 expand in length they will slide through the production platform deck 20 through conductor guides 42.

In places the conductor may be suitably stiffened with ring stiffener 47.

As noted on FIG. 1 at the bottom of the pump casings 7 and 12 are springs 9 and 10 or other devices to slow the descent of the sucker rods 6 and 13 in a smooth manner and to change their direction without putting any stress on the chain 2, sprockets 4, gear box 34 or drive motor 3.

When the petroleum is pushed up by the pumps below not shown, the petroleum will go through the right gap 18 or left gap 19 that exists between the pump casings 7 and 12 and the conductors 8 and 11.

When the petroleum is brought up from the reservoir it will leave the system through the right outlet 17 or the left outlet 16 into the process system or a pipeline or into some other suitable system.

Referring to FIG. 6 there is shown a cross sectional view of the pump device 1 taken from FIG. 3.

The motor 3 turns the motor drive shaft 51 which turns the gears not shown or the chains and sprockets also not shown or other devices which turn the sprocket drive shaft 52. The sprocket drive shaft 52 turns the drive sprocket 4 that causes the chain 2 to move.

The sprocket drive shaft 52 and the sprocket 4 are held in place by bearings not shown which are held in place by the bridge plate 5. The bridge plates 5 are held together by bottom plate 53 which also forms an oil bath 27 for the chain 2 and other mechanical devices not shown.

Referring to FIG. 7 there is a cross sectional view taken from FIG. 4 of the pump device 1 setting on the pump casing 7 and 12.

The bridge plates 5 are shown supported on trunnion shaft 43 which also supports two cam followers 36. The trunnion shaft 43 is supported by the pump support 46. The pump support 46 also supports the main idler sprocket shaft 54 which supports either the left upper idler sprocket 24 or the right upper idler sprocket 25. The pump support 46 is supported by the transition piece 45 that is attached to the pump casings 7 and 12 by nuts and bolts 40 with the upper flange 41 and the top flange 50.

Referring to FIG. 8 there is shown a cross sectional plan view of the pump device 1 taken through FIG. 4 showing the relationship of various parts.

The trunnion shaft 43 is shown supported by the pump support 46 and supporting the bridge plates 5 and the cam followers 36. The cam followers 36 keep the pump device 1 and the chain 2 in alignment with the center of the pump casings 7 and 12 and conductors 8 and 11 but still allow the conductors 8 and 11 to expand upward and contract downward. The cam followers 36 are held in alignment by the guide frame 35.

Also shown attached to the pump support 46 is the left upper idler sprocket 24 and the right upper idler sprocket 25. These two sprockets are connected to the pump support 46 in such a manner as to always keep the chain 2 centered on the centerline of the pump casings 7 and 12 not shown in this view.

As noted earlier the motor 3 causes motor drive shaft 51 to turn the gears not shown in the gear box 34 that turns the sprocket drive shaft 52 that turns the drive sprocket 4 that moves the chain 2. The chain 2 is not shown for clarity passes over the drive sprocket 4 and under the right lower idler sprocket 22 and left lower idler sprocket 23 through an oil bath 27 contained between bridge plates 5 and bottom plate 53, to lubricate the chain 2 as it moves.

Referring to FIG. 9 there is shown a bridge plate 5 with connections for the sprocket drive shaft 52 and the lower idler sprocket shafts 55.

The trunnion shaft 43 is shown on each side of the bridge plate 5 with the slot 44 in the left side of the bridge plate 5. There are various reinforcing boss plates 56 of different shapes and sizes to hold the different shafts. There are also various stiffener members 57 suitably attached to the bridge plates 5 by welding or other means to strengthen the bridge plates 5.

Also shown is the approximate height of the oil bath 27 that lubricates the chain 2 and items of the pump device 1.

Referring to FIG. 10 there is shown a section view taken from FIG. 7.

This figure shows the ring stiffener 47 that forms a T section with the ring web plate 58 to strengthen the transition piece 45 or other members. The web plate 58 is shown welded or fastened in another suitable manner to the transition piece 45. Also shown sufficiently supported by the ring stiffener 47 and the ring web plate 58 are the cam follower shafts 59 and the cam followers 36. The chain 2 is shown passing through the transition piece 45 directly over the center of the conductors 8 and 11 not shown in this view.

Referring to FIG. 11 through FIG. 17 there is shown a series of superimposed views of the pump device 1 on an offshore production platform 60 as it progresses through various stages of the pumping cycle.

Figure 11:
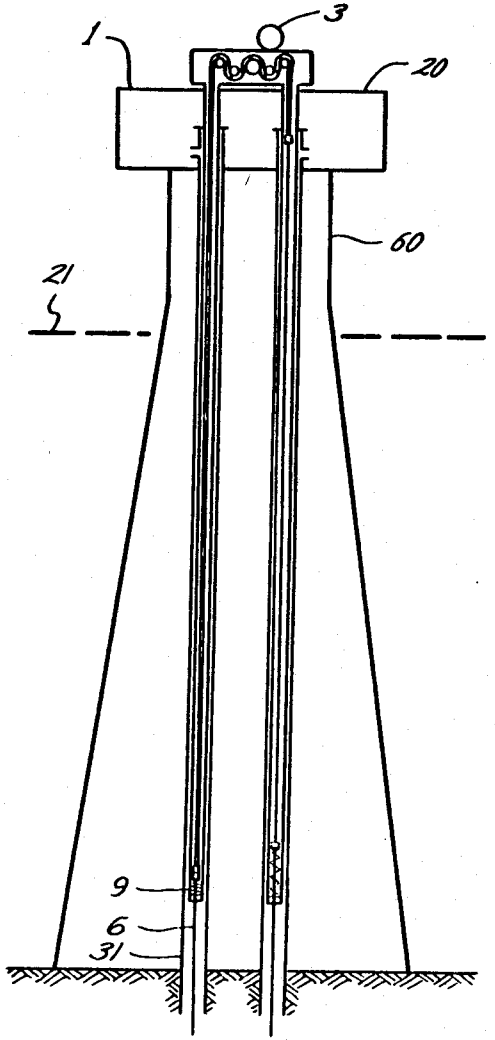
FIG. 11 is a superimposed view of a pumping unit on an offshore production platform in the first stage of cycle 1.

FIG. 11 shows the start of the first cycle. The left spring 9 is compressed. The left sucker rod 6 is as deep into the left well 31 as it can go. The drive motor 3 is momentarily shut off by a timer not shown located in the control unit 28 also not shown. The well is not in production for a microsecond or more.

Figure 12:
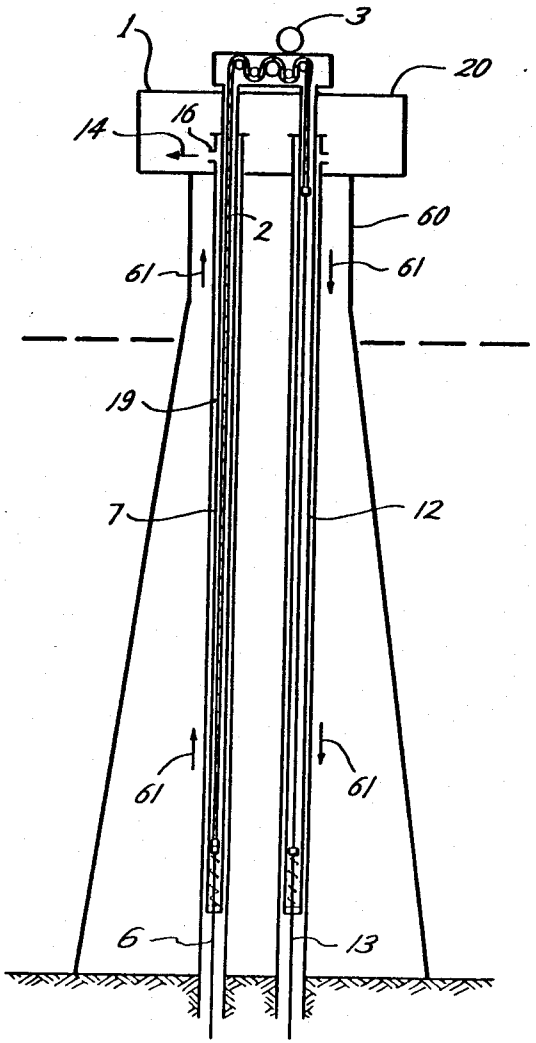
FIG. 12 is a superimposed view of a pumping unit on an offshore production platform in the second stage of cycle 1.

FIG. 12 shows the left spring 9 rebounding. The drive motor 3 is activated causing the gear box 34 not shown to turn the drive sprocket 4. As the drive sprocket 4 turns, the chain 2 is pulled up in the left pump casing 7 and at the same time the chain 2 starts to descend into the right pump casing 12. The right sucker rod 13 is pulling down on the chain 2 assisting the motor 3 and drive sprocket 4 in lifting the left sucker rod 6.

Petroleum will start to flow upward through the left gap 19 and out of the left outlet 16. The arrows 61 indicate the direction of chain and sucker rods.

Figure 13:
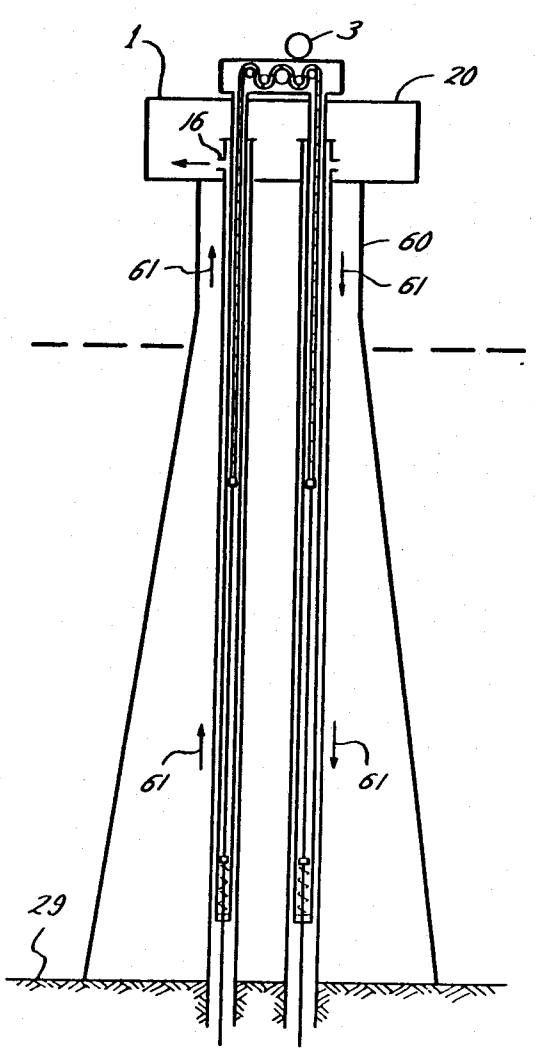
FIG. 13 is a superimposed view of a pumping unit on an offshore production platform during the middle stage of cycle 1.

FIG. 13 shows the left sucker rod 6 continuing to move upward 61 and petroleum will continue to move out of the left outlet 16. A counter in the control unit 28 not shown is counting the chain links as they pass by a given point or it may be counting the revolutions of one of the sprockets to keep time and to control the velocity of the sucker rods, and to know when to shut off and later reverse the direction of the motor 3.

Figure 14:
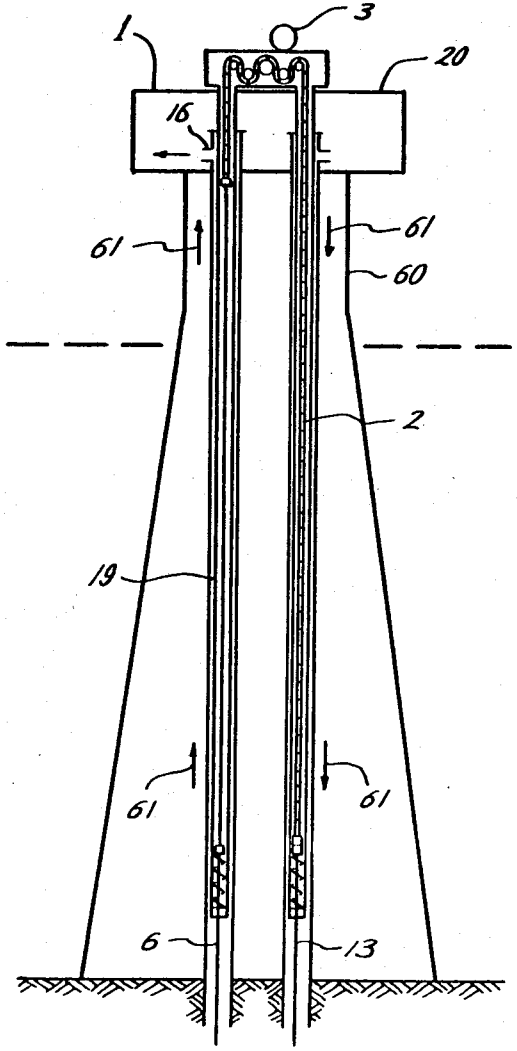
FIG. 14 is a superimposed view of a pumping unit on an offshore production platform during the later stage of cycle 1.

FIG. 14 shows the left sucker rod 6 continuing to move upward 61 but nearing the end of the upward cycle. The left sucker rod 13 and chain 2 have become longer and are therefore exerting more downward energy than the right sucker rod 6 with the short end of chain 2. The drive motor 3 may be shut down now and only the counter weight action or inertia will keep the right sucker rod 13 moving downward 61 and the left sucker rod 6 moving upward.

Petroleum will continue to flow through the left gap 19 and out of the left outlet 16.

Figure 15:
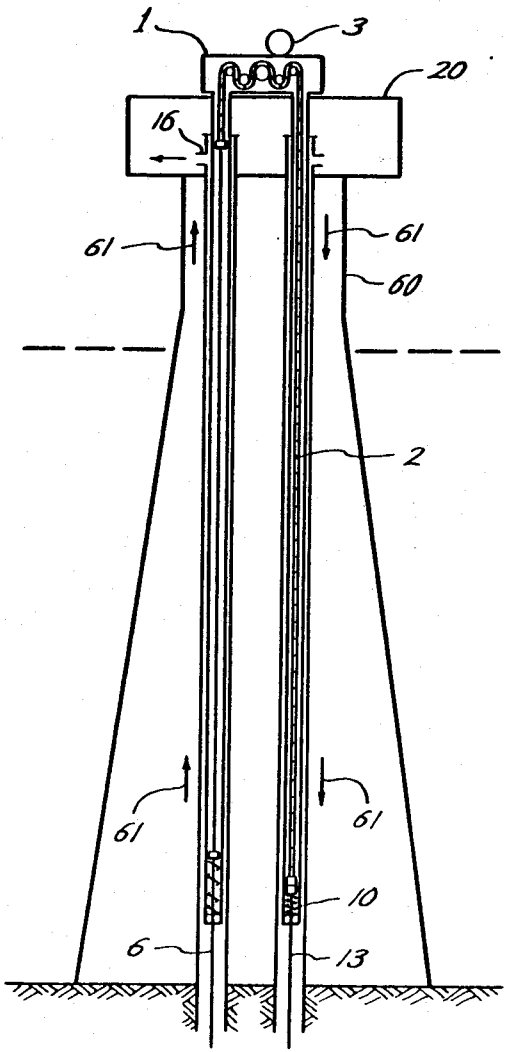
FIG. 15 is a superimposed view of a pumping unit on an offshore production platform during the last stage of cycle 1.

FIG. 15 shows the end of the first cycle prior to the start of the second cycle.

The right spring 10 is compressing the drive motor 3 is shut off. The left sucker rod 6 is moving upward 61 the same distance as the right spring 10 compresses downward. There will still be some petroleum moving up the left gap 19 and out of the left outlet 16.

Figure 16:
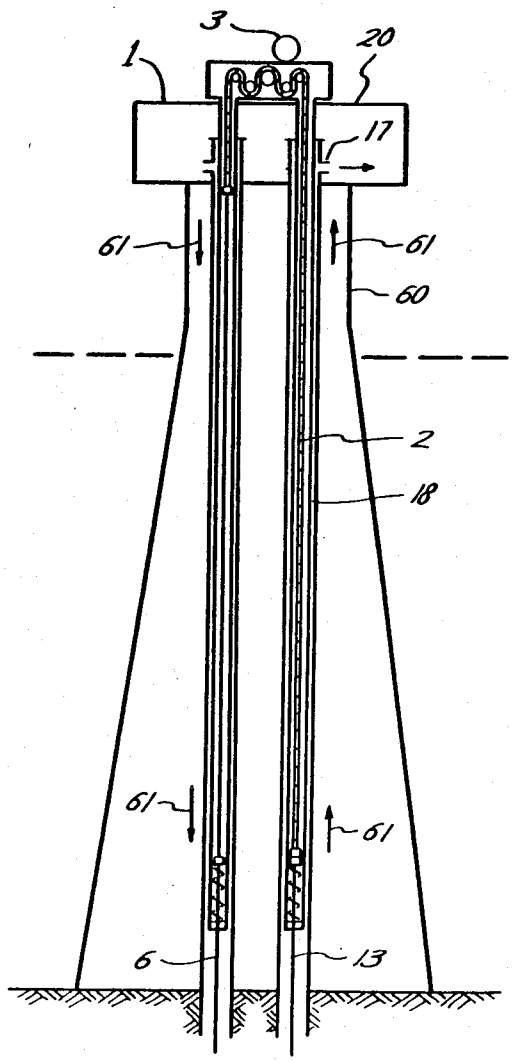
FIG. 16 is a superimposed view of a pumping unit on an offshore production platform during the first stage of cycle 2.

FIG. 16 shows the start of the second cycle.

The right spring 10 has rebounded upward. The drive motor 3 has turned on and is running in a direction that is reverse to the direction of FIGS. 12, 13 and 14.

Petroleum has started moving up the right gap 18 and out of the right outlet 17. The left sucker rod 6 is now descending into the left well 31 and has started to act as a counter weight to the right sucker rod 13 that is moving in an upward direction 61.

Figure 17:
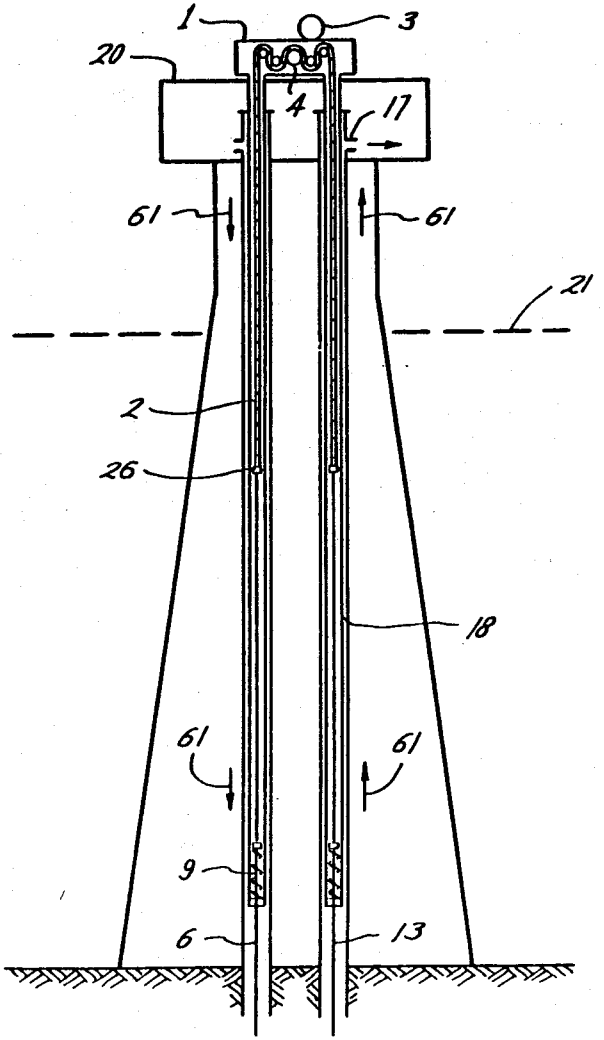
FIG. 17 is a superimposed view of a pumping unit on an off-shore production platform during the mid stage of cycle 2.

FIG. 17 shows the pump device 1 in the middle of the second cycle.

The right sucker rod 13 is moving upward 61 and the left sucker rod 6 is moving downward 61 and is acting as a counter weight to the right sucker rod 13 which is assisting the drive motor 3 the gear box 34 not shown and the drive sprocket 4.

Petroleum is flowing through the right gap 18 and the right outlet 17.

This cycle will continue until the left spring 9 is compressed by the chain 2 and the chain to sucker rod connector 26. This will end the second cycle and start the first cycle again.

Figure 18:
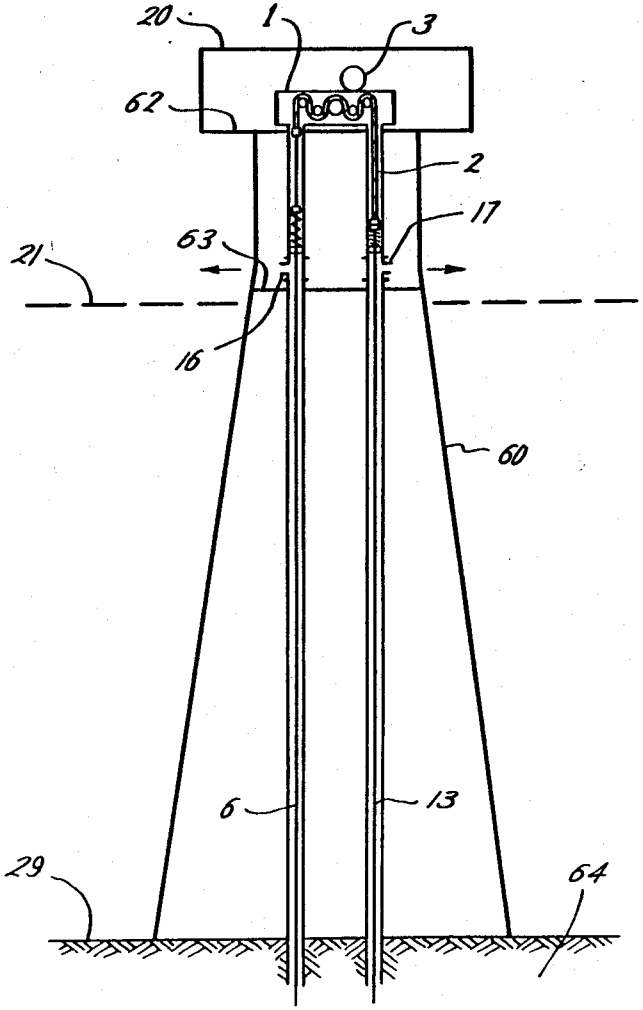
FIG. 18 is a superimposed view of a pumping unit on an off-shore production platform showing a different location for the pump.

FIG. 18 shows that the pump device 1 can be placed on the lower deck 62 and the left outlet 16 and right outlet 17 can be placed on the cellar deck. The right outlet 17 and the left outlet 16 can also be placed below the surface of the sea 21. The right outlet 17 and the left outlet 16 can also be placed on the sea floor 29. The right outlet 17 and the left 16 outlet can also be placed below the sea floor. The last three locations for the right outlet 17 and the left outlet 16 to be placed below the surface of the sea, to be placed on the sea floor or to be placed below the surface of the sea 64 are not shown.

The pump device 1 may also be fitted with watertight and gastight seals and may be placed below the surface of the sea 21, on the sea floor 29 or below the sea floor 64 all not shown.

Figure 19:
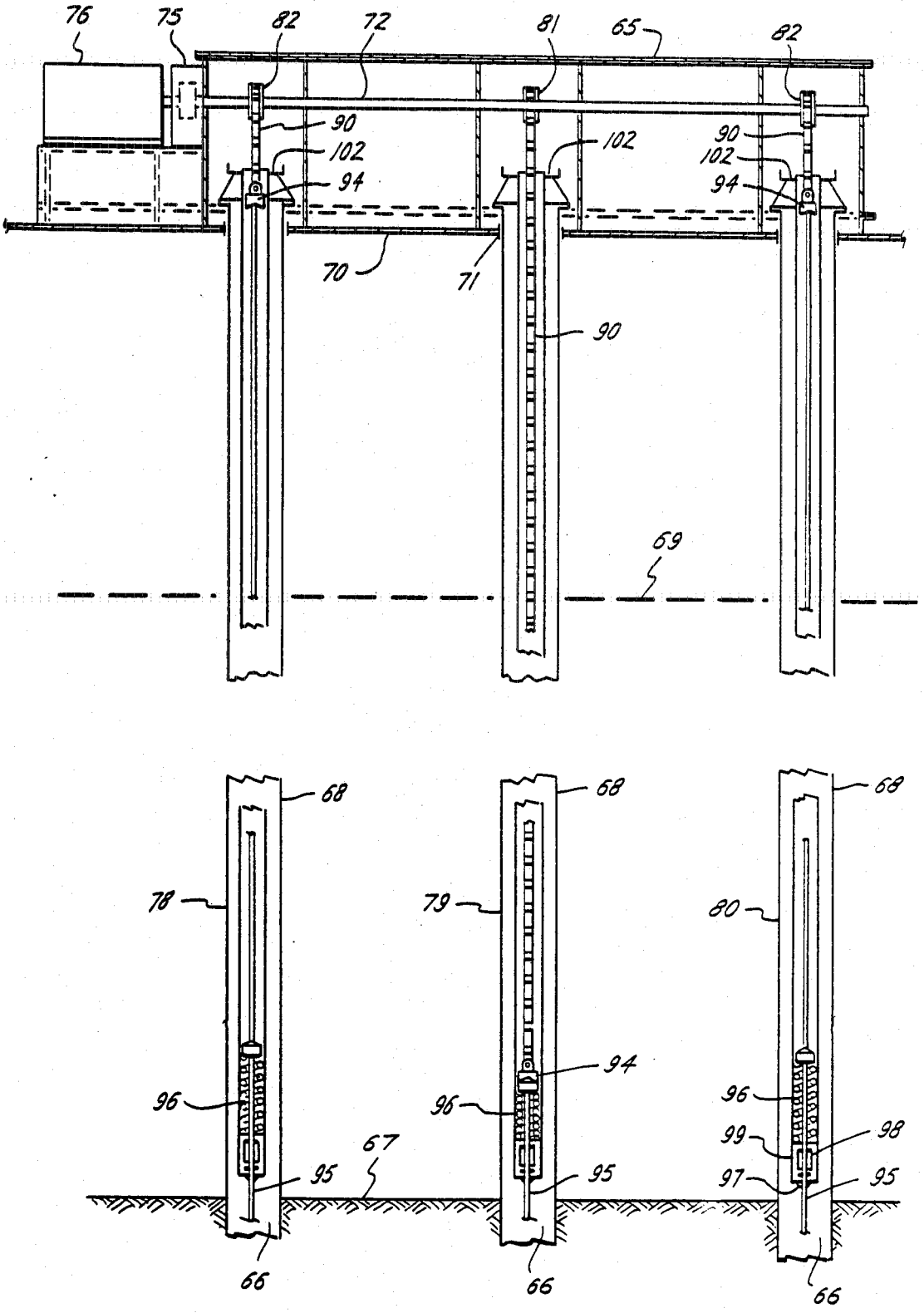
FIG. 19 is a sectional elevation of another embodiment of a three well multiwell pumping system.

Referring to FIG. 19 there is shown another embodiment of a three well multiwell pump. The pump device described earlier is for an even number of wells such as two, four, six, eight and so on. The following embodiment will handle odd numbered wells such as three, five, seven and so on. They may also be used in combination with the even numbered well system.

FIG. 19 is a sectional elevation of a three well in line pump device 65. This is used when three wells 66 are in almost a straight line with each other. The well 3 is brought up to the sea floor 67 in conductors 68 and go through the surface of the sea and up through the production platform deck 70. This may also be done on land without a deck. The conductors are allowed to move up and down freely through the deck 70 and are held in place by conductor guides 71. The conductors may not move sideways.

The three well in line pumping device 65 is shown suitably attached to the platform deck 70 by welding or bolting to a foundation or it is fastened by some other suitable means. The three well in line pumping device 65 may also be attached to the conductors 68 in a similar manner as the pump device 1 of the preferred embodiment.

The three well in line pumping device is run on a long shaft 72 and a short shaft 73 to be shown later in FIG. 22. Both shafts 72 and 73 are rotated 74 by the gear box 75 which may be gear driven or chain driven not shown. The gear box 75 is motivated by a drive motor 76.

Figure 22:
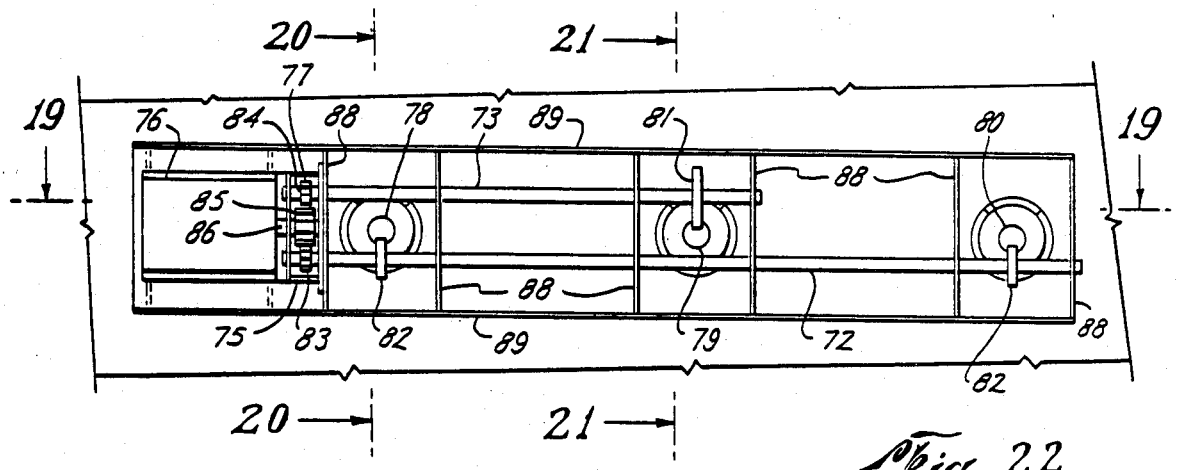
FIG. 22 is a plan view of another embodiment of the multiwell pump.

Referring to FIG. 22 there is shown a plan view that will give the location of the long shaft 72 and the short shaft 73 and their relationship with each other and the wells 66.

As the drive motor 76 turns the gears 77 in the gear box 76 in a clockwise direction both the long shaft 72 and the short shaft 73 will turn in a counter clockwise direction. The large diameter sprocket 81 on the short shaft will turn counter clockwise with the shaft pulling chain and sucker rod out of well 2; at the same time the long shaft 73 is also rotating counter clockwise but it is on the other side of the wells 1, 2 and 3 and has a small diameter sprocket that is lowering chain and sucker rod into wells 78 and 80.

The three wells 78, 79 and 80 could each have approximately the same depth and weight per sucker rod and chain for the following explanation.

Large diameter sprocket 81 will have a mechanical disadvantage in lifting capacity over small diameter sprockets 82. Since the diameter of the large diameter sprocket 81 is say two (2) feet and the diameter of the small diameter sprocket 82 is say one (1) foot then the torque exerted on the short shaft 73 with the large diameter sprocket will be approximately twice (2 times) as much as the torque exerted on the long shaft 73 with only one small diameter sprocket 82. With two small diameter sprockets 82 combined on the long shaft 73, the combined torque of the two small diameter sprocket 82 will equal the total torque exerted on the large diameter sprocket 81.

The velocity and the amplitude of the stroke of the sucker rod will be greater with the large diameter sprocket 81 than with the two small diameter sprockets 82 but three wells 78, 79 and 80 will be pumping petroleum using the sucker rods of two wells to counter the weight of the sucker rod of one well and the sucker rod of one well will also be countering the weight of the sucker rods of two wells.

When the large diameter sprocket 81 applies torque to the short shaft 73 and the small diameter sprockets 82 apply torque to the long shaft 72 that torque will be exerted on the long shaft gear 83 and the short shaft gear 84. The force of each will offset each other in the drive gear 85 that is connected to the drive motor 76 by drive shaft 86.

These forces can also be offset or neutralized by varying the diameter of the gears in the gear box 75. Assuming that the sprockets 87 on the long shaft 72 and the short shaft 73 were the same diameter. The short shaft gear 84 would be about twice the diameter of the long shaft gear box 84. The results would be that the torque exerted on the drive gear 85 from the short shaft gear 84 would be equal and opposite to that torque exerted on the drive gear by the smaller diameter long shaft gear 83. The end results of this would be that one sucker rod would be used as a counter weight for two sucker rods or two sucker rods would be used as a counter weight for one sucker rod.

The long shaft 72 and the short shaft 73 are supported by bearings and or bushings not shown. The bearings or bushings are further supported by support plates 88. The support plates 88 are welded or attached to longitudinal support plates 89 which are suitably attached to the deck 70 or a concrete slab or foundation on land not shown.

Referring to FIG. 20 there is shown a cross sectional view taken through FIG. 22 of the small diameter sprocket 82.

The chain 90 is shown in the chain locker 91 and some of the chain 90 in the pump casing 92. The chain 90 shown in the chain locker 91 is then turned around on idler sprocket 93 and then wrapped around the small diameter sprocket 82 that controls the direction of the chain 90. The chain 90 ends with the chain to sucker rod connector 94. The chain to sucker rod connector 94 is connected to the sucker rod 95 that runs all the way into the bottom of the well not shown.

At the bottom of the pump casing 92 is a spring 96 that will compress when the chain to sucker rod connector 94 reaches the bottom of the pump casing 92 and reverses its cycle to come back up. The chain to sucker rod connector 94 compresses the spring 96 during or after the drive motor 76 is shut off and the system is free wheeling. When the spring 96 rebounds upwards the drive motor 76 will turn on again in a reversed direction and with the assistance of the sucker rod 95 on the large diameter sprocket 81 will pull up the sucker rod 95 with the small diameter sprocket 82.

At the bottom of the pump casing is a rod bearing 99 to keep the sucker rod aligned, a rod packing 98 that is a seal to keep the petroleum out of pump casing 92 and to keep from losing the lubricating fluid or oil from the pump casing 92. Below the rod bearing 99 is a rod wiper 97 to wipe off all of the dirt, sand or other containments that could damage the rod bearing 99 and the rod packing 98.

When the sucker rod 95 is moved up petroleum will flow through the gap 100 and through the outlet 101 into the production system or pipeline not shown.

The entire chain locker 91, and pump casing 92 are to be lowered into the conductor 68 and bolted together at the top in the same manner as shown on the preferred embodiment of FIG. 5.

At the top of the conductor 68 and pump casing 92 is an oil drip pan 102 to catch any excess lubricating oil that may spill off of the chain. The system will be lubricated with a spray system, or a drop system or a bath in the pump casing 92 or the chain locker 91.

Referring to FIG. 21 there is shown a cross sectional view taken through FIG. 22 of the large diameter sprocket 81.

The only difference in section 20 and 21 is the size of the large diameter sprocket 81 and the location of the sprocket. Reference should be made to FIG. 20 for details of FIG. 21.

Referring back to FIG. 19 there is shown the items as in FIG. 20 and FIG. 22.

Well 1-78 is shown at the top of its stroke. Well 2-79 is shown at the bottom of its stroke with the spring 96 compressed. Well 3-80 is shown at the top of its stroke.

Figure 24:
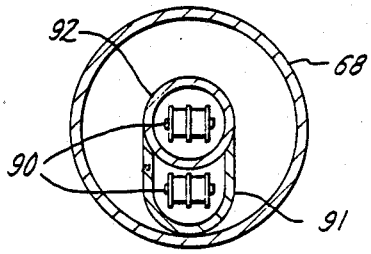
FIG. 24 is a cross sectional view of the well and the pump casing.

Referring to FIG. 24 there is shown a cross section of the conductor 68 taken from FIG. 20.

The chain locker 91 is attached to the pump casing 92 by welding or other suitable means. The chain 90 is shown inside of both the chain locker 91 and the well casing 68.

Figure 23:
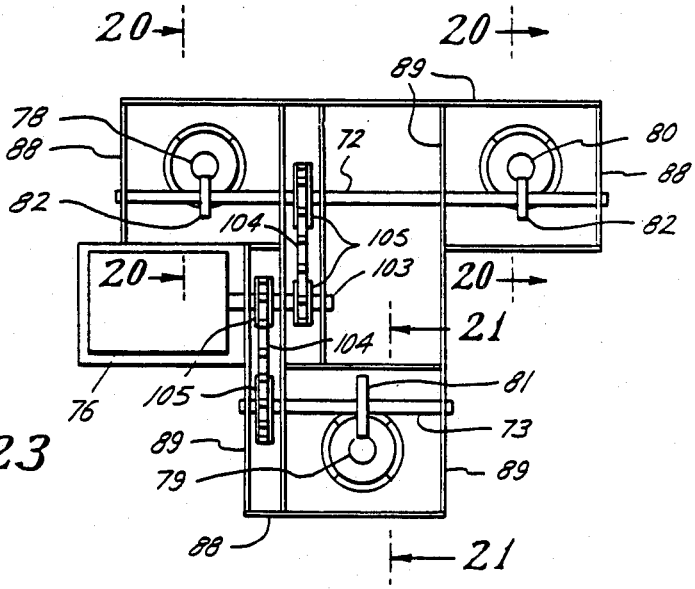
FIG. 23 is still another plan view of still another embodiment of the multiwell pump.

Referring to FIG. 23 there is shown a plan view of still another embodiment of a multiwell pump. The conductors 68 are arranged in a pattern to form a triangle. This is common in offshore production platforms.

The concept is the same as that of FIG. 22, the sucker rods 95 of two wells 66 are acting as counterweights for the sucker rod 95 for one well 66. Two wells 78 and 80 have small diameter sprockets 82 held in place over them by the long shaft 72. They are shown connected to the drive shaft 103 by a chain drive 104. The chain drive 104 consists of a drive sprocket 105 on the drive shaft 103 and another drive sprocket 105 on the long shaft 72. There is still another drive sprocket 105 on the drive shaft 103 and a drive sprocket 105 on the short shaft 73. The short shaft 73 has suitably mounted to it the large diameter sprocket 81.

Although a chain drive 104 system is shown in this embodiment a gear drive or even a belt drive could be utilized to drive and or control this system.

The three well triangle drive pump device 106 will have the support plates 88, longitudinal support plates 89, bearings and bushings as shown with the three well in line pump device 65.

Figure 25:
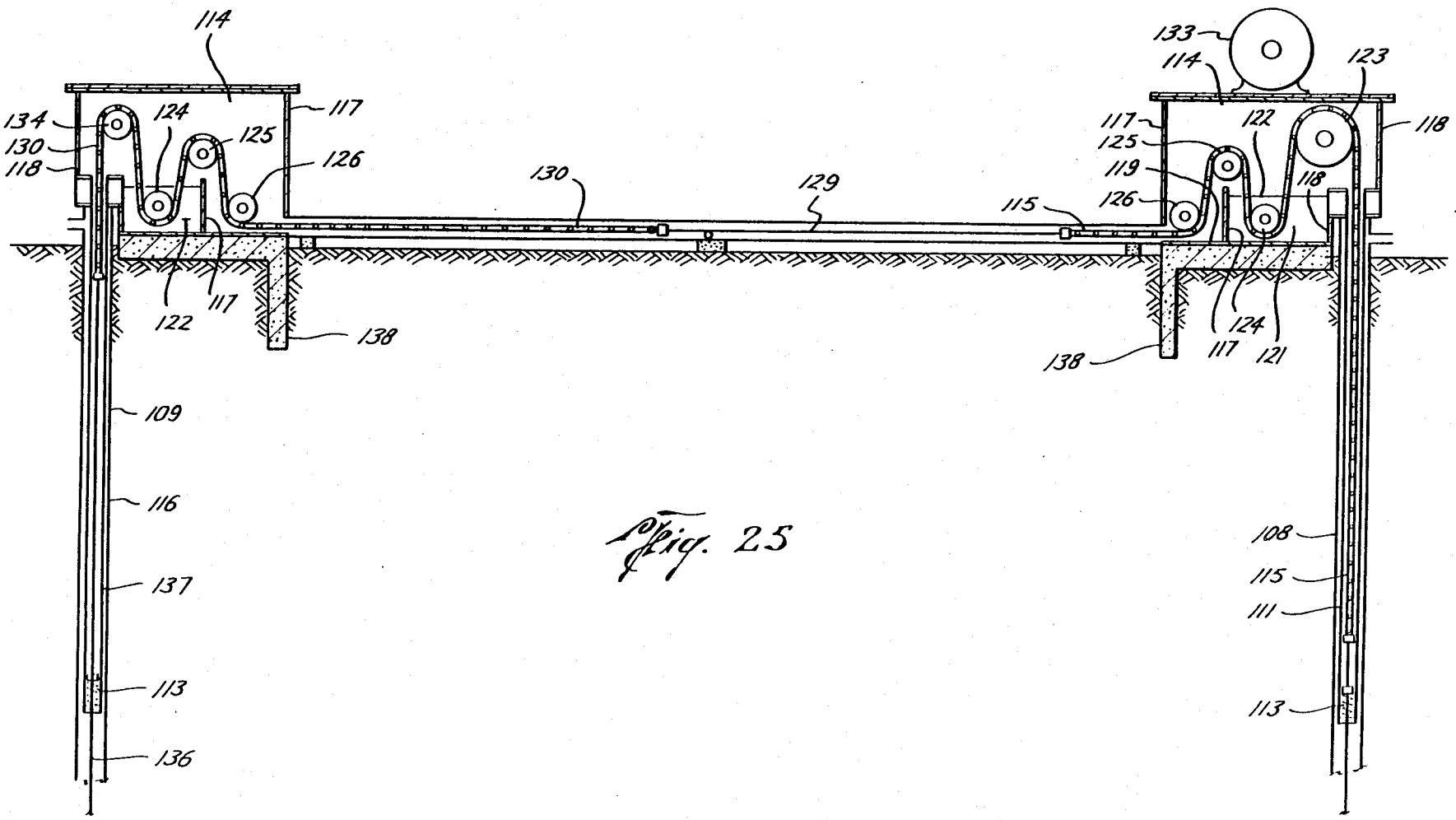
FIG. 25 is a sectional elevation of still another embodiment showing the pumping device on land.

Referring to FIG. 25 there is shown still another embodiment of the right pumping device 107 shown on land over a right well 108 and a left pumping device 128 shown over the left well 109.

Starting with the right well 108 the mechanical chain 115 is shown inside of the right well casing 110. The right chain 111 is suitably connected to the right sucker rod 112. At the bottom of the right well casing 110 is a spring device 113 that will absorb the shock of the right sucker rod 112 as it reaches the lowest point of its stroke and changes direaction from down to up.

At the top of the right well 108 there is shown the pump side plate 114 suitably connected to the top of the right well casing 110. The pump does not always have to be connected to the right well casing 110 or the left well casing 116. There are two side plates 114 that support the various sprocket shafts and other devices. There are also two end plates 117 and 118 and a bottom plate 119. Suitably fastened to side plates 114 and bottom plate 119 are two container plates 120. The container plates 120 form a container 121 for an oil bath 122.

The right mechanical chain 115 runs up through the right pump casing 111 over the right drive sprocket, down into the oil bath 122, under the oil bath idler sprocket 124, over the upper idler sprocket 125 and then down under the lower idler sprocket 126 and into the chain tunnel 127. The right mechanical chain 115 is shown suitably connected to a cable 129 that could be a wire rope or kevlar line or some other suitable device such as rods, etc. The right mechanical chain 115 may be suitably connected to the left mechanical chain 130 to form one mechanical chain not shown. The cable 129 may be supported in rollers 131 or other suitable devices suitably held in place in the chain tunnel 127. The chain tunnel 127 may be above the ground 132 as shown or below the ground not shown.

The cable 129 is suitably connected to the right mechanical chain 115 at one end and it is also suitably connected to the left mechanical chain 130 at the other end. The left mechanical chain 130 runs under the lower idler sprocket 125, under the oil bath sprocket 124 over the well head idler sprocket 134 and into the left well casing 135 where it connects with the left sucker rod 136 that runs down into the left well 109 and left pump casing 137.

Both the left pumping device 128 and the right pumping device 107 are shown set on a concrete slab foundation 138 suitably designed to take the stresses imposed by the pumping device.

On the top of the left pumping device 128 and the right pumping device 107 there is a cover plate to keep out rain, snow, dust or other contaminants from the sprockets and oil.

The right drive sprocket is driven in the same manner as is pumping device one (1) by a motor 133, a gear box or chain not shown and a drive shaft not shown that is connected to the drive sprocket 123.

The drive means can go on the left pumping device 128 or the right pumping device 107.

Figure 26:
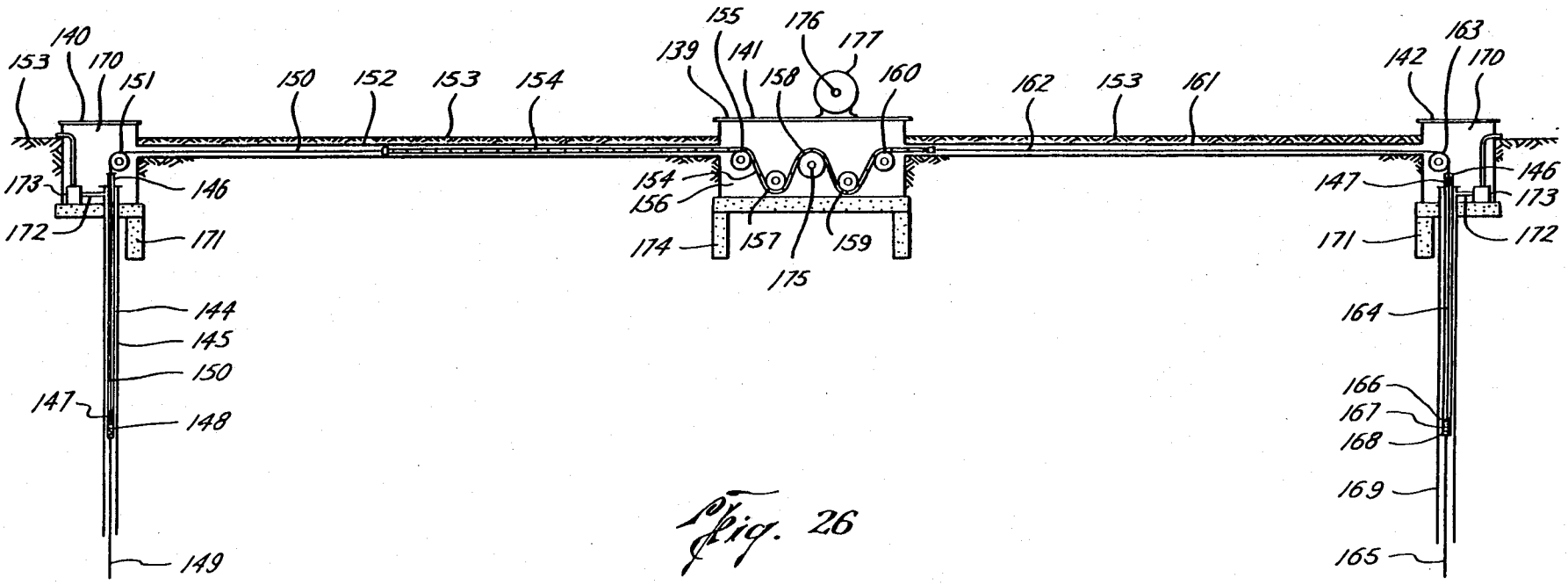
FIG. 26 is a sectional elevation of still another embodiment showing the pumping device in another land configuration.

Referring to the FIG. 26, there is shown still another embodiment of the pump device on land.

The three unit pump device 139 has a left well unit 140, a central drive unit 141 and a right well unit 142. The left well unit 140 is over the left well 143. Inside of the left well 143 is a pump casing 144 that is flexibly attached and held in place at the top by an exterior spring 146. The exterior spring 146 will allow the pump casing 144 to move up and down inside of the left well casing 145. The purpose of the exterior spring 146 is to absorb the shock on the line to sucker rod connector 147 as it hits the base plate 148 of the left well casing 145.

The left sucker rod 149 is suitably connected to the left rope 150, made up of steel or wire or kevlar or nylon or other suitable material. The rope 150 passes through the pump casing 144, and runs over the left well sheave 151 and into the left rope trunk 152 that is shown below the ground 153 but could also be above the ground 153. The rope 150 is suitably connected to the drive chain 154.

The drive chain 154 runs into the central drive unit 141 where it runs over the left upper idler sprocket 155, down into an oil bath 156, under the left lower idler sprocket 157, up over the drive sprocket 158, back down into the oil bath 156, under the right lower idler sprocket 159, up over the right upper idler sprocket 160 and into the right rope trunk 161. The drive chain 154 is suitably connected to the right rope 162 where it runs through the right rope trunk 161, over the right well sheave 163, down into the right pump casing 164 where it is suitably connected to the right sucker rod 165 by the line to sucker rod connector 147. The right sucker rod 165 runs through the right pump casing, through the base plate 148, through the bearing 166, not shown, through the packer 167, not shown, and through the rod scraper 168, also not shown, and into the right well 169.

The method of pumping is the same as the other embodiments, each sucker rod is counterweight for the other sucker rod.

The sheaves 151 and 153 are held in place by the side plates 170 and other means not shown. Both the right well unit 142 and the left well unit 140 are set on foundations 171 made up of concrete or other suitable material.

When oil flows through the outlets 172 a booster pump 173 may be required to pump the petroleum into a tank or a pipeline, etc.

The central drive unit 141 is shown setting on a foundation 174 made of concrete or other suitable material.

The drive sprocket is turned by a drive shaft 175 which is turned by a gear box not shown which is turned by a motor drive shaft 176 which is turned by the motor 177. The central drive unit 141 is made up of steel sides, bottom and top with suitable access and vent means.

Although the system described in detail supra has been found to be most satisfactory and preferred, many variations in mechanics, structure and method are possible. For example, wire ropes could be used instead of mechanical chain, the motor could be hydraulic, steam or even a diesel or gas engine with a clutch and reverse gear. The sprockets could be replaced with pullies and shelves. The pump casing that is a means of protecting the chain could be eliminated with a chain that may not require lubrication or that could be lubricated by the petroleum being pumped out of the ground. The chain locker could also be eliminated with other means of protection or lubrication. The spring at the bottom of the pump casing could be placed at the top of the pump casing. The unit could be made air tight, water tight and it could be pressurized for subsea operations or subterranean production systems. The system could be made to be activated by the waves thus eliminating the requirements of outside power sources. The systems can be placed side by side to operate or pump over one hundred wells per offshore production platform. The systems could be placed to pump wells, utilizing one sucker rod as a counter weight for another sucker rod or two sucker rods as a counter weight for one sucker rod where the wells are over several thousand feet apart. The system could be used, for example, where ten (10) sucker rods could be utilized as counter weights for twenty (20) sucker rods.

The above are examplary of the possible changes or variations. Because many varying and different embodiments made within the scope of the inventive concept herein taught and because many modifications may be made in the embodiments herein detailed in accordance with the descriptive requirements of law, it should be understood that the details herein are to be interpreted as illustrative and not in a limiting sense.

I claim:

1. A balanced pumping apparatus for pumping two laterally spaced wells comprising:

a left conductor on a left said well;

a right conductor on a right said well;

a left pump casing inside said well conductor;

a right pump casing inside said right well conductor;

a left sucker rod inside said left pump casing;

a right sucker rod inside said right pump casing;

flexible linkage means for attachment to the top ends of said right sucker rod and left sucker rod;

a drive motor with a rotating shaft;

a drive sprocket connected to said shaft and rotatably engaging said flexible linkage means;

a separate pump casing flange attached to the upper section of each said well conductors;

a separate upper flange attached to the upper section of each said pump casing and positioned at an axial location above the point where its respective said pump casing flange is attached to said pump casing;

a separate transition piece attached to the top of each said pump casing flange;

a separate pump support attached to the top of each said transition piece;

a plate-like structural support means placed in a vertical plane above said well conductors and supporting said drive motor, said drive sprocket, said flexible linkage means, and said sucker rods;

a structural load transfer means connecting said plate-like structural support means to said well conductors;

a motor control unit having means for supporting itself and controlling said drive motor; and a separate shaft extending across each pump support.

2. The balanced pumping apparatus of claim 1, wherein there is further included a means for allowing said well conductors to expand axially without bending.

3. The balanced pumping apparatus of claim 1 wherein there is further included structural means for maintaining the vertical orientation of said well conductors.

4. The balanced pumping apparatus of claim 1, wherein is further included a separate trunnion shaft extending across each pump support.

5. The apparatus of claim 4, wherein said plate-like structured support means includes a bridge plate journaled to receive the ends of said shafts.

* * * * *